United States Patent [19]

Kelly

[11] Patent Number: 4,688,865

[45] Date of Patent: Aug. 25, 1987

[54] CIRCUIT DEVICE FOR CONNECTION TO CONTACTS IN A ROW

[75] Inventor: John F. Kelly, Elgin, Ill.

[73] Assignee: Teradyne, Inc., Boston, Mass.

[21] Appl. No.: 847,329

[22] Filed: Apr. 2, 1986

[51] Int. Cl.[4] ..... H01R 9/09

[52] U.S. Cl. ..... 439/79; 200/51.1; 439/62; 439/108

[58] Field of Search ..... 339/17 L, 17 LC, 17 LM, 339/17 M, 198 R, 198 N; 361/119, 124; 179/91 R, 96, 97, 98, 190; 200/51.1; 379/317, 321

[56] References Cited

U.S. PATENT DOCUMENTS 3,316,521 4/1967 Fletcher, Jr. et al. ..... 339/176 M
3,842,212 10/1974 Miller ..... 339/17 LC
3,927,275 12/1975 Deitch et al. ..... 179/97
4,398,779 8/1983 Ling ..... 339/17 LC

*Primary Examiner*—Neil Abrams

[57] ABSTRACT

A circuit device for connection to contacts located near each other in a row of first contacts in a recess or recesses of electrical apparatus along a first contact axis, the device including a printed circuit board carrying electronic components, and a connecting member attached to and extending from the board and sized to be received in and supported by the recess or recesses with the board oriented transversely to the first contact axis. Second contacts are supported by the member and include contact areas spaced from each other along the first contact axis for mating with corresponding first contacts, whereby the device is connected to corresponding first contacts without blocking access to other first contacts.

16 Claims, 4 Drawing Figures

CIRCUIT DEVICE FOR CONNECTION TO CONTACTS IN A ROW

FIELD OF THE INVENTION

The invention relates to a circuit device connected to contacts in a row on electrical apparatus.

BACKGROUND OF THE INVENTION

A so-called Krone telephone network interconnection block is used to connect a plurality of user phones to a telephone network in some countries. The block has contacts regularly spaced in very close proximity to each other in two rows along the block on opposite sides of an insertion slot. Each contact has a fixed forked end with opposing knife edges designed to cut through insulation of an electrical wire inserted between them and a movable end resiliently biased against the movable end of the respective contact in the other row. Each user phone is connected to two contacts in a row.

SUMMARY OF THE INVENTION

I have discovered that a circuit on a printed circuit board (PCB) can be easily connected to some contacts near each other in a row of first contacts along a first contact axis without blocking access to other first contacts by providing an connecting member that extends from the bottom of the PCB, supports the PCB transverse to the first contact axis, and includes second contacts spaced from each other along the first contact axis.

In preferred embodiments, the connecting member includes an insulating support board that is mounted perpendicular to the PCB, the support board having the second contacts printed on it; the support board or PCB is slotted so that there are portions of the support board on both sides of the PCB, and the second contacts are electrically connected to conductors on both sides of the PCB; there are two rows of opposing first contacts and there are second contacts on both sides of the support board; there also is a third contact connected to the PCB and spaced from the second contacts for contacting a ground bus bar; there is a shell enclosing the PCB and a base at the bottom of the shell including an opening through which the support board passes; the PCB comprises a remote isolation device; and there are a plurality of remote isolation devices provided along the row of first contacts.

Other advantages and features of the invention will be apparent from the following description of a preferred embodiment thereof and from the claims.

DESCRIPTION OF THE PREFERRED EMBODIMENT

The drawings will be briefly described first.

DRAWINGS

STRUCTURE

Figure 1:
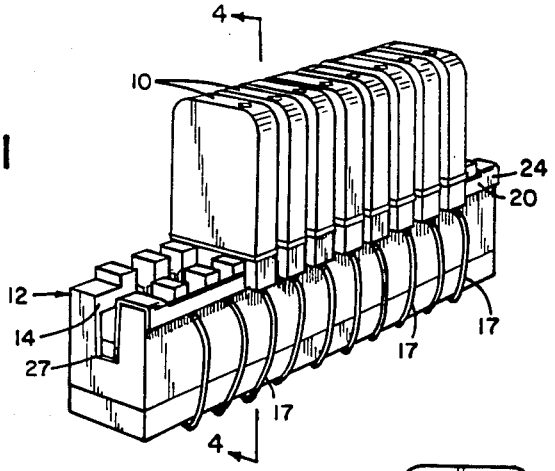
FIG. 1 is a diagrammatic perspective view showing a plurality of circuit devices according to the invention mounted along electrical apparatus carrying a row of first contacts.
Figure 4:
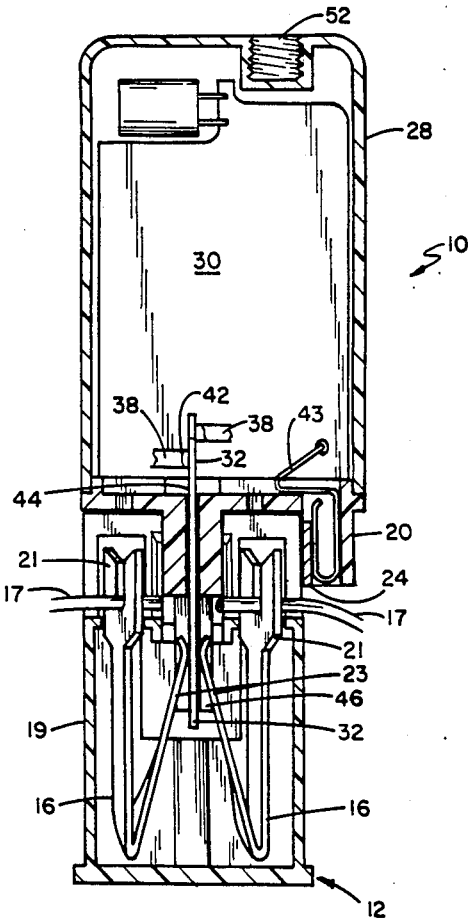
FIG. 4 is a vertical sectional view, taken at 4—4 of FIG. 1.

Referring to FIGS. 1 and 4, a plurality of circuit devices 10 are shown mounted along the length of Krone block 12, carrying two rows of contacts 16 on both sides of slot 14 and spaced from adjacent contacts in a row by about ⅛". Wires 17 on one side of block 12 are connected to the telephone network, and wires 17 on the other side are connected to the user's telephones. Contacts 16 are mounted in insulating housing 19 of block 12 and have fixed forked ends 21 with knife edges that cut through insulation of wires 17 inserted between them and movable contact ends 23. In the absence of something between opposing contact ends 23, they touch each other (not shown), and there is connection between wires 17 connected to opposing contacts 16. Circuit device 10 is a remote isolation device responsive to certain test signals provided over the telephone network to either permit connection of the user's telephone lines to the network or to isolate the user's lines from the network to facilitate testing, e.g., for the location of a fault.

Figure 2:
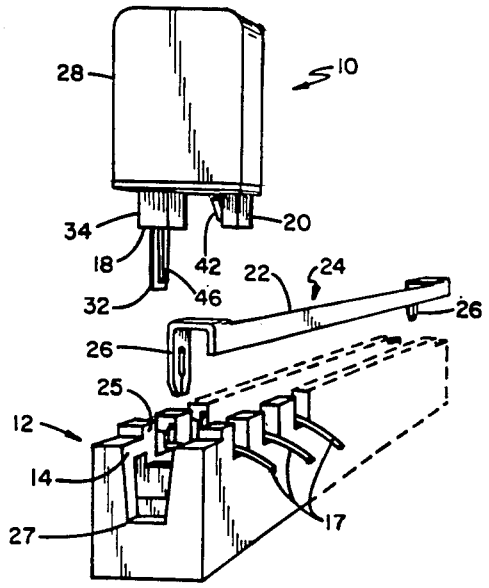
FIG. 2 is an exploded view showing the FIG. 1 circuit device and an accompanying bus bar separated from the electrical apparatus carrying the first contacts.

Referring to FIG. 2, it is seen that circuit device 10 includes connecting member 18, which includes support board 32 and base 34 (both described later in more detail) and is received in a recess 25 along slot 14. Circuit device 10 also includes overhanging tab 20 on the outside of central portion 22 of bus bar 24. Ends 26 of bus bar 24 are offset from central portion 22, are received within slot 14 and engage ground terminals 27 at both ends of block 12. Bus bar 24 is made of 0.030 inch thick stainless steel.

Figure 3:
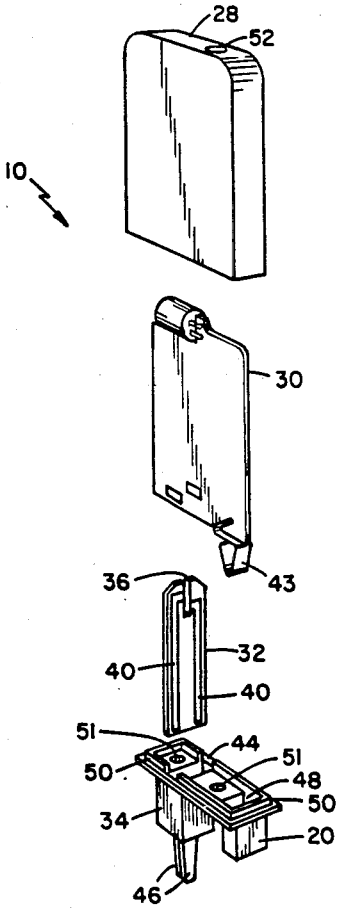
FIG. 3 is an exploded perspective view of the FIG. 1 circuit device.

Referring to FIG. 3, it is seen that circuit device 10 includes outer shell 28, printed circuit board (PCB) 30 carrying electronic components (most of which are not shown) providing the remote isolation device circuit, perpendicular support board 32, and base 34. As is seen in FIG. 4, when assembled, the bottom central portion of PCB 30 is within slot 36 of support board 32, and conductive traces 38 on PCB 30 are electrically connected to corresponding conductive traces of second contacts 40 on support board 32 via solder 42. PCB 30 and support board 32 are made of 0.031 inch thick NEMA grade FR-4 glassy epoxy. Traces 38 and second contacts 40 are 2 ounce copper cladding with gold plate. Slot 36 is 0.035"±0.003"−0.000" wide. Spaced from second contacts 40 and connected to PCB 30 is resilient ground contact 43 made of 0.010" thick, alloy 260 brass, spring temper. Cover 28 and base 34 are made of rigid PVC.

Base 34 includes 0.046"±0.005" wide slot 44 for receiving support board 32. At the bottom of slot 44 and on opposite sides of it are supporting legs 46, which extend beyond the bottom of support board 32 and are narrower than support board 32 (FIG. 2) so that second contacts 40 extend beyond the sides of legs 46 and are exposed. Adjacent to tab 20 is opening 48 through which ground contact 43 passes. On the uppper surface of base 34 are pads 50 sized to fit within the bottom of shell 28 to properly align shell 28 and base 34, which are secured together by sonic welding. Holes 51 in base 34 are used to inject potting material.

At the top of shell 28 is threaded recess 52 to assist in removing one of a plurality of circuit devices 10 mounted close together in a row on Krone block 12.

OPERATION

In use, each Krone block 12, typically mounted parallel to a plurality of other Krone blocks 12, receives one bus bar 24 and a plurality of circuit devices 10. Ends 26 of bus bar 24 engage ground terminals 27 (FIG. 1). Connecting members 18 of circuit devices 10 fit into recesses 25 along rows of first contacts 16. Second contacts 40 on circuit devices 10 align and mate with respective first contacts 16 of Krone block 12, and ground contacts 43 of devices 10 make electrical contact with ground bus bar 24.

Because PCBs 30 of devices 10 are mounted perpendicular to slot 14, each one only takes up a small space along slot 14, and they can all be mounted directly adjacent to Krone block 12 and need not be connected by wires or be separately supported.

If it is desired to remove a single circuit device 10, a threaded member can be screwed into its opening 52 to assist in removing it.

OTHER EMBODIMENTS

Other embodiments of the invention are within the scope of the claims.

What is claimed is:

1. A circuit device for connection to first contacts located near each other in a row of first contacts in a recess or recesses of an electrical apparatus, said first contacts being located in a row along a first contact axis, said recess or recesses having recess widths along second axes transverse to said first contact axis, said recess or recesses being open on one side along third insertion axes, said device comprising a printed circuit board (PCB) carrying electronic components and having an edge along said second axis longer than said recess widths, said board having, when mounted, its short dimension along axes parallel to said first contact axis and its longer dimensions along axes parallel to said second and third axes, and a connecting member attached to and extending from said edge of said PCB along a said third axis and sized to be received in a said recess and supported by said apparatus with said board oriented transversely to said first contact axis, said connecting member including an insulating support board having a dimension along a said second axis less than said recess width and a dimension along said first axis that is longer than said dimension along said second axis, said insulating support board thus being substantially perpendicular to a plane of a face of said PCB having said longer dimensions, said insulating support board including second contacts on a first surface of said insulating member that is parallel to said first axis, said second contacts having contact areas spaced from each other along said first contact axis for mating with corresponding said first contacts, said insulating support board having second surfaces not having any contacts on them, said PCB having only one said connecting member and one said insulating support board for being received by a single recess, whereby said device is electrically connected to said corresponding first contacts without blocking access to other said first contacts located along said row.

2. The device of claim 1 wherein there are portions of said support board on both sides of said printed circuit board.

3. The device of claim 2 wherein said portions of said support board extend above the bottom of said printed circuit board.

4. The device of claim 3 wherein said support board or said printed circuit board has a slot for receiving therein a portion of the other.

5. The device of claim 2 wherein one said second contact is connected to a conductor on one side of said printed circuit board and another said contact is connected to a conductor on the other side of said printed circuit board.

6. The device of claim 1 wherein said apparatus has two parallel rows of opposing first contacts, and wherein there are second contacts on both sides of said insulating member.

7. The apparatus of claim 1 further comprising a third contact carried by said printed circuit board and spaced from said second contacts in a direction perpendicular to said first contact axis.

8. The apparatus of claim 7 wherein said third contact is resilient, and further comprising an insulating tab supporting said third contact.

9. The apparatus of claim 7 further comprising an elongated bus bar adapted to be mounted on said apparatus and contacted by said third contact.

10. The apparatus of claim 1 further comprising a shell enclosing said printed circuit board.

11. The apparatus of claim 10 further comprising a base connected to said shell and including an opening through which said support board passes.

12. The apparatus of claim 11 wherein said base has legs on both sides of said support board that are narrower than said support board, thereby exposing second contacts on said support board on both sides of said legs.

13. The apparatus of claim 1 wherein said printed circuit board carries electronic components comprising a remote isolation device.

14. The combination comprising electrical apparatus including a member with a row of first contacts in a recess or recesses along a first contact axis, said recess or recesses having recess widths along second axes transverse to said first contact axis, said recess being open on one side along third insertion axes, plural circuit devices mounted adjacent to each other along said axis, each said device including a printed circuit board (PCB) carrying electronic components and having an edge along said second axis longer than said recess widths, said board having, when mounted, its short dimension along axes parallel to said first contact axis and its longer dimensions along axes parallel to said second and third axes, and a connecting member attached to and extending from said edge of said PCB along a said third axis and sized to be received in a said recess and supported by said apparatus with said board oriented transversely to said first contact axis, said connecting member including an insulating support board having a dimension along a said second axis less than said recess width and a dimension along said first axis that is longer than said dimension along said second axis, said insulating support board thus being substantially perpendicular to a plane of a face of said PCB having said longer dimensions, said insulating support board including second contacts on a first surface of said insulating member that is parallel to said first axis, said second contacts having contact areas spaced from each other along said first contact axis for mating with corresponding said first contacts, said insulating support board having second surfaces that are transverse to said first axis, said second surfaces not having any contacts on them, said PCB having only one said connecting member and one said insulating support board for being received by a single recess, a third contact spaced from said second contacts and aligned in a row along a fourth axis that is parallel to said first axis, and an elongated bus bar mounted on said apparatus and contacting said third contacts of said device along a device contact portion along said fourth axis.

15. The combination of claim 14 wherein said bus bar has ends offset from said device contact portion and engaging a voltage distributing connection on said electrical apparatus.

16. The combination of claim 14 in which said printed circuit boards comprise remote isolation devices.

* * * * *

UNITED STATES PATENT OFFICE

CERTIFICATE OF CORRECTION

Patent No. 4,688,865 Dated August 25, 1987

Inventor(s) John F. Kelly

It is certified that error appears in the above-identified patent and that said Letters Patent are hereby corrected as shown below:

Column 3, line 8 after "along" insert --slot 14 such that PCBs 30 are perpendicular to the axes along--.

Signed and Sealed this

Twenty-second Day of December, 1987

*Attest:*

DONALD J. QUIGG

*Attesting Officer*

*Commissioner of Patents and Trademarks*